US005332137A

United States Patent [19]

Violette

[11] Patent Number: 5,332,137

[45] Date of Patent: Jul. 26, 1994

[54] MUSICAL INSTRUMENT HARNESS

[76] Inventor: Michael Violette, 17 Huntsman La., Commack, N.Y. 11725

[21] Appl. No.: 57,624

[22] Filed: May 5, 1993

[51] Int. Cl.[5] ..... A45F 5/00

[52] U.S. Cl. ..... 224/257; 84/327; 224/204; 224/264; 224/901; 224/910

[58] Field of Search ..... 224/910, 901, 202, 204, 224/224, 257, 264; 84/327

[56] References Cited

U.S. PATENT DOCUMENTS

| | | | |
|---|---|---|---|
| 3,305,148 | 2/1967 | Zimmerman | 224/257 X |
| 4,168,022 | 9/1979 | Brewer | 224/257 |
| 4,279,367 | 7/1981 | Jacobs | 204/257 |
| 4,630,763 | 12/1986 | Friedman | 224/910 X |
| 4,656,917 | 4/1987 | Van Halen | 84/327 |
| 4,802,613 | 2/1989 | Terney | 224/204 |
| 4,930,695 | 6/1990 | Thompson et al. | 224/257 |
| 5,069,103 | 12/1991 | Healy | 84/327 |

FOREIGN PATENT DOCUMENTS

| | | | |
|---|---|---|---|
| 2141282 | 12/1984 | United Kingdom | 84/327 |

*Primary Examiner*—Ernest G. Cusick
*Attorney, Agent, or Firm*—Allen R. Morganstern

[57] ABSTRACT

This invention relates to a new and improved design associated with the fabrication and construction of a musical instrument harness capable of supporting a guitar, banjo, and/or other like musical instrument. In accordance with the invention, the harness attaches itself at three separate and distinct locations to the musical instrument in question such that the weight of the musical instrument is apportioned and otherwise distributed to different portions of a musicians body so as to prevent, minimize and/or otherwise overcome fatigue. By having a waistband component that is adjustably attachable about the waist of the musician and by having a shoulder strap component that adjustably affixes one end thereof to the portion of the waistband component positioned at the base of the back of the musician and the other end thereof attached to the musical instrument along with there being two side-band components which also each adjustably attach at one end thereof to the waistband component and the other ends thereof to two separate locations on the musical instrument, there is achieved the ability to provide a musical instrument harness that can be adjusted to meet the physical characteristics of any musician and that additionally minimizes the fatigue of the musician during the playing of the instrument.

2 Claims, 2 Drawing Sheets

MUSICAL INSTRUMENT HARNESS

BACKGROUND AND OBJECTS OF THE INVENTION

This invention relates to a new and improved design associated with the fabrication and construction of a musical instrument harness capable of supporting a guitar, banjo, and/or other like musical instrument. In accordance with the invention, the harness attaches itself at three separate and distinct locations to the musical instrument in question such that the weight of the musical instrument is apportioned and otherwise distributed to different portions of a musicians body so as to prevent, minimize and/or otherwise overcome fatigue. Additionally, the design of the musical instrument harness results in the positioning of the musical instrument in close proximity to the body of the musician. By having a waistband component that is adjustably attachable about the waist of the musician and by having a shoulder strap component that adjustably affixes one end thereof: to the portion of the waistband component positioned at the base of the back of the musician and the other end thereof attached to the musical instrument along with there being two side-band components which also each adjustably attach at one end thereof to the waistband component and the other ends thereof to two separate locations on the musical instrument, there is achieved the ability to provide a musical instrument harness that minimizes the fatigue of the musician during the playing of the instrument.

Although it is well known in the prior art to have musical instrument harnesses capable of assisting a musician in supporting a musical instrument such as a guitar, none of the prior art harnesses address themselves to the specific structure, advantages and expediencies associated with the present invention, With regard to said prior art which addresses itself to harness structures, it should be noted that the following patents evidence such structures, however, same do not anticipate nor otherwise teach the present invention. More particularly, the prior art referred to above is as follows: U.S. Pat. No. 4,930,695, entitled "Support System for Guitar or Like Instrument", issued to Thompson and Peters on Jun. 5, 1990; U.S. Pat. No. 306,871, entitled "Strap for Guitar or Similar Article", issued to Bracy on Mar. 27, 1990; U.S. Pat. No. 4,279,367, entitled "Musical Instrument Harness", issued to Jacobs on Jul. 21, 1981; U.S. Pat. No. 4,630,763, entitled "Apparatus for Supporting the Weight of a Banjo in Adjustable Proportions from Both the Torso and the Shoulders of a Player", issued to Friedman on Dec. 23, 1986; and U.S. Pat. No. 1,810,519, entitled "Combined Xylophone and Carrying Apparatus", issued to Gerhart on Jun. 16, 1931.

In keeping with the invention, it is a specific object thereof, to create a musical instrument harness that is simple in construction and whose use is facilitated by its design.

It is another object of the present invention to create a new and improved musical instrument harness wherein the musical instrument is maintained and otherwise supported in a position in close proximity to the musicians body.

It is another object of the present invention to create a new and improved musical instrument harness wherein fatigue is reduced with regard to the playing of an instrument that utilizes the harness design of the present invention.

It is another object of the present invention to create a new and improved musical instrument harness wherein the harness is capable of being selectively adjusted to fit the body dimensions of any musicians without losing the advantages of the invention.

The objects and advantages of the invention are set forth in part herein and in part will be obvious herefrom, or may be learned by practice of the invention, the same being realized and attained by means of the instrumentalities and combinations pointed out in the appended claims.

The invention consists in the novel parts, constructions, arrangements, combinations and improvements herein shown and described.

DESCRIPTION OF A PREFERRED EMBODIMENT

Figure 3:
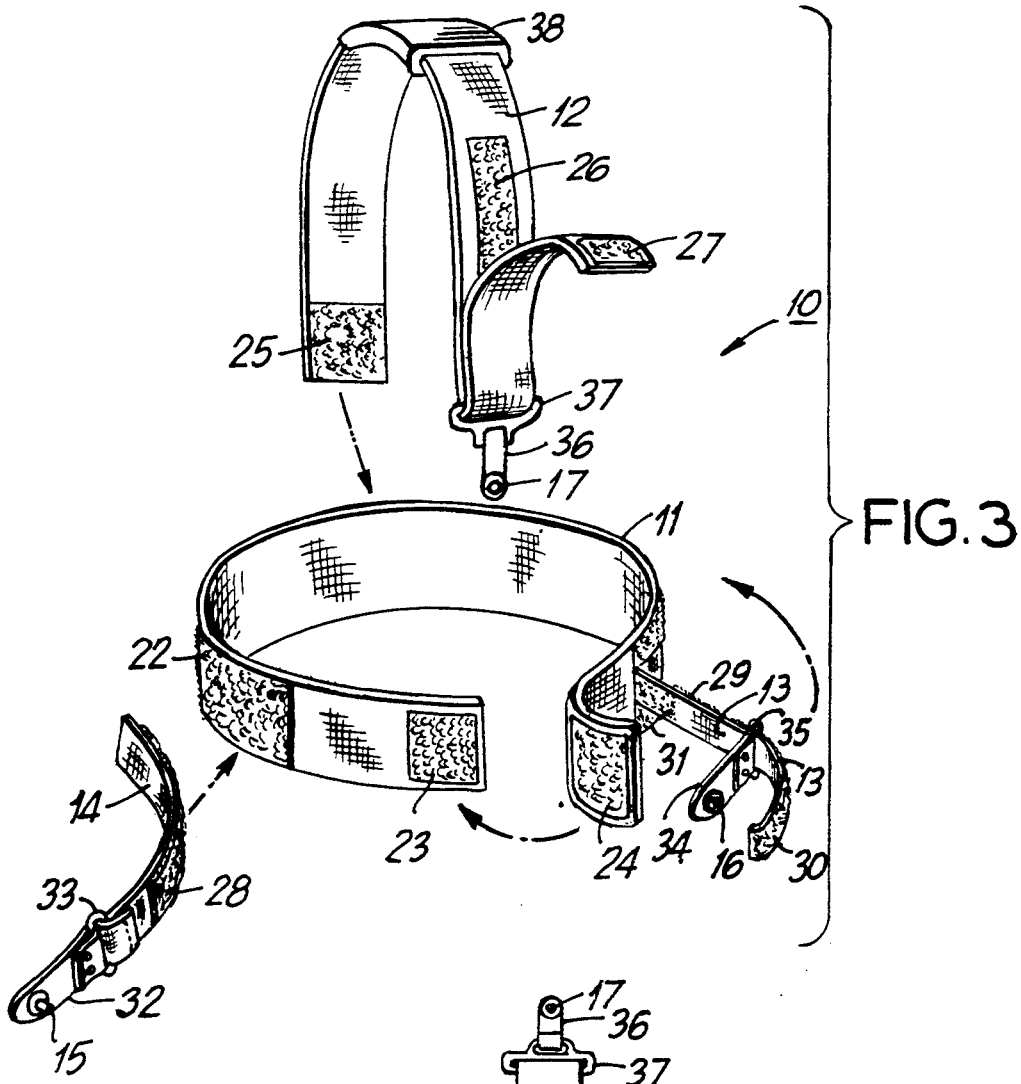
FIG. 3 is a three dimensional perspective view of the musical instrument harness constructed in accordance with the invention evidencing the interrelationship of its component members prior to the component members interacting with each other to create the musical instrument harness.

Reference is now herein made to FIG. 3 wherein there is depicted a three-dimensional perspective view of musical instrument harness "10" constructed in accordance with the invention wherein the component members of musical instrument harness "10" are depicted prior to their interaction with each other. As depicted in FIG. "3", musical instrument harness "10" comprises a waist band "11", a shoulder strap "12", a right side band "13", and a left side band "14".

In keeping with the invention, waist band "11" is designed to be selectively attachable about the waist of a musician and is adjustable as to size, based upon the fact that VELCRO®, a hook and loop fastener, is utilized at the coupling point of waist band "11", as is well known in the prior art. The function waist band "11", in conjunction with musical instrument harness "10", is to address a means whereby most of the weight of the musical instrument in question is born about the waist of the musician utilizing musical instrument harness "10".

In accordance with the invention, waist band "11" shoulder strap "12", right side band "13" and left side band "14" have structurally affixed thereto various VELCRO® patches as will be hereinafter referred to whereby the selective attachability and detachability of the above referenced components of musical instrument harness "10" is achieved so as to accomplish a customized fitting of musical instrument harness "10" to the particular body features and preferences of a particular musician.

More particularly, as depicted in FIGS. "3" and "4" the drawings, waist band "11" has structurally affixed as depicted therein on the outer face of said waist band at one of its ends, VELCRO® patch "23". As further depicted in FIG. "3", waist band "11" has structurally affixed to it at the end opposite to the end where VELCRO® patch "23" is attached, VELCRO® patch "24", VELCRO® patch "24", however, being structurally affixed to the inner surface of waist band "11" as depicted in FIG. "3". It should be noted that VELCRO® patch "23" and VELCRO® patch "24" are of opposite and otherwise compatible VELCRO® structures such that the placing in structural contact of VELCRO® patch "23" with VELCRO® patch "24" will result in the structurally adhering to each other of said respective VELCRO® patches. Additionally, as depicted in FIGS. "3" and "4", VELCRO® patch "22" is structurally affixed to the outer surface of waist band "11" for purposes of allowing for the selective attachability and detachability as will hereinafter be discussed of right side band "13", left side band "14" and shoulder strap "12" thereto.

Figure 4:
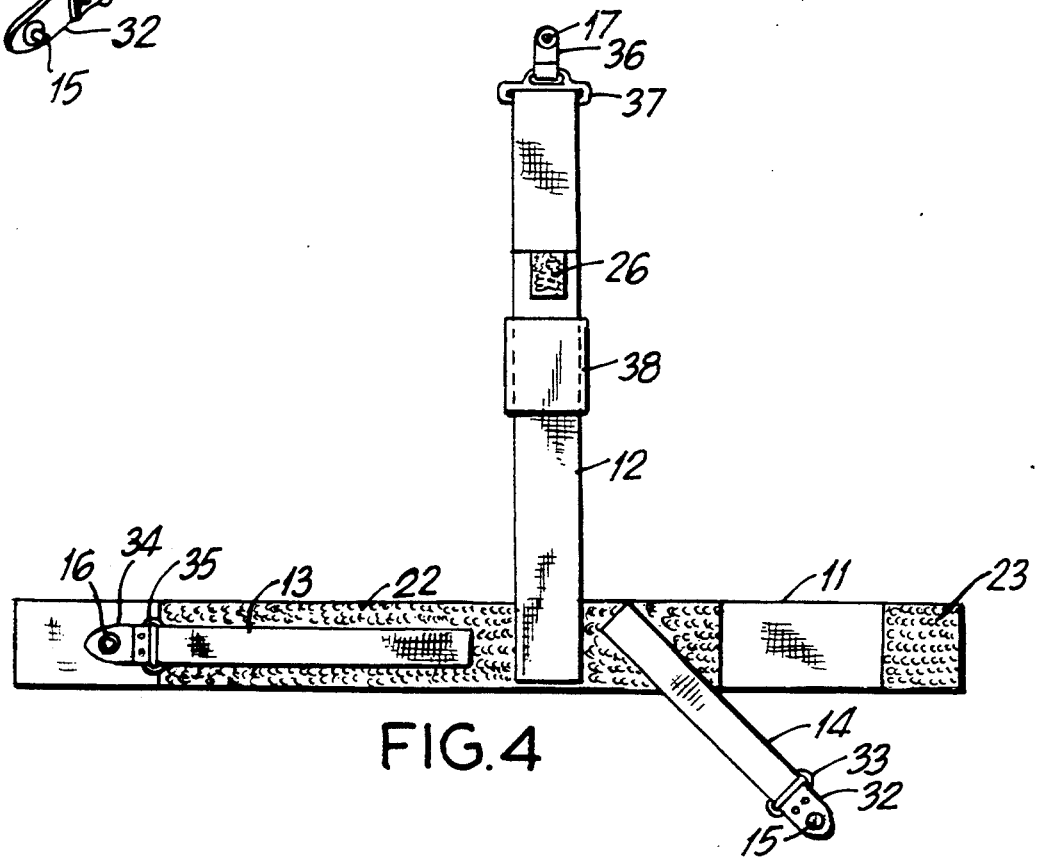
FIG. 4 is a front elevational view of the musical instrument harness constructed in accordance with the invention depicting said musical instrument harness in a two dimensional view.

As further depicted in FIGS. 3 and 4, VELCRO® patch "25" is structurally affixed to the inner surface of shoulder strap "12" at the end thereof that is structurally affixed to waist band "11" as depicted in FIG. "4" It should be noted that VELCRO® patch "25" and VELCRO® patch "22 are of opposite and otherwise compatible VELCRO® structures such that the placing in structural contact of VELCRO® patch "25" with VELCRO® patch "22" will result in the structural adhering to each other of said respective VELCRO® patches.

In further keeping with the invention, and as related to shoulder strap "12", VELCRO® patch "26" and VELCRO® patch "27" are structurally affixed to the outer surface of shoulder strap "12" as depicted in FIG. "3" on the surface of said shoulder strap "12" opposite to the surface to which VELCRO® patch "25" is affixed to shoulder strap "12" Additionally, VELCRO® patch "27" is affixed at the end of shoulder strap "12" opposite to the end shoulder strap "12" to which VELCRO® patch "25" is attached. It should be noted that VELCRO® patch "26" and VELCRO® patch "27" are of opposite and otherwise compatible VELCRO® structures such that the placing in structural contact of VELCRO® patch "26" with VELCRO® patch "27" will result in the structural adhering to each other of said respective VELCRO® patches. Upon the structural affixing of VELCRO® patch "27" to VELCRO® patch "26" as depicted in FIGS. "3" and "4", there is created a loop arrangement with shoulder strap "12" whereby male snapping means "17" becomes selectively attachable to shoulder strap "12". By adjusting where VELCRO® patch "27" will come in contact with VELCRO® patch "26", one also achieves the ability to selectively adjust the functional length of shoulder strap "12" so as to customize the length of shoulder strap "12" to fit a particular musician and/or musical instrument.

Upon further review of FIG. "3", there is further depicted VELCRO® patch "28" which is structurally affixed to left side band "14". It should be noted that VELCRO® patch "28" and VELCRO® patch "22" are of opposite and otherwise compatible VELCRO® structures such that the placing in structural contact VELCRO® patch "28" with VELCRO® patch "22" will result in the structural adhering to each other of said respective VELCRO® patches.

As also depicted in FIG. "3", right side band "13" has structurally affixed to its outer surface VELCRO® patch "29" and VELCRO® patch "30" as well as having VELCRO® patch "31" affixed to its inner surface, VELCRO® patch "31" being attached at one end of right side band "13" while VELCRO® patch "30" is attached to the end of right side band "13" opposite to the end of right side band "13" to which VELCRO® patch "31" is attached and on the surface of right side band "13" opposite to that to which VELCRO® patch "31" is attached. It should be noted that VELCRO® patch "31" and VELCRO® patch "22" are of opposite and otherwise compatible VELCRO® structures such that the placing in structural contact of VELCRO® patch "31" with VELCRO® patch "22" will result in the structural adhering to each other of said respective VELCRO® patches. It should also be noted that VELCRO® patch "30" and VELCRO® patch "29" are also of opposite and otherwise compatible VELCRO® structures such that the placing in structural contact of VELCRO® patch "30" with VELCRO® patch "29" will result in the structural adhering to each other of said respective VELCRO® patches.

In keeping with the invention and as stated above and as depicted in FIG. "3", right side band "13" is selectively attachable to waist band "11" through the utilization of VELCRO® or other commonly known fastening means. Additionally, left side band "14" is also selectively attachable to waist band "11" through the utilization of VELCRO® or other commonly known fastening means. Similarly, shoulder strap "12" is also selectively attachable to waist band "11", as depicted in FIG. "4", by utilization of VELCRO® or other fastening means well known in the prior art. By the use of VELCRO® or other well known fastening means and due to the fact that left side band "14" and right side band "13" are each selectively affixable to waist band "11" as is shoulder strap "12", one is able to achieve a personalized fit and/or positioning of left side band "14", right side band "13" and shoulder strap "12" in conjunction with guitar instrument "18" as related to waist band "11" as depicted in FIGS. "1" and "2". As a result of the above, a more comfortable and less fatiguing harness arrangement is achieved as compared to prior art harnesses available to date.

In keeping with the invention, it should be understood that inherent in the structural arrangement associated with shoulder strap "12", right side band "13", left side band "14" and waist band "11", is the ability to adjust the lengths associated with shoulder strap "12", right side band "13", left side band and waist band "11" and the angular interrelationship between said interacting components when assembled in accordance with the invention.

As depicted in FIG. 3, and in keeping with the above, the length of shoulder strap "12" is adjustably determined by the location of where VELCRO® patch "27" comes into contact with VELCRO® patch "26" Similarly, the length of right side band "13" is adjustably determined by the location of where VELCRO® patch "30" comes into contact with VELCRO® patch "29".

Additionally, as depicted in FIG. 3, and in keeping with the above, the usable length of waist band "11" is adjustably determined by the location of where VEL- CRO® patch "24" comes into contact with VELCRO® patch "23".

In further keeping with the invention, it should further be noted that the interrelationship between shoulder strap "12" with waist band "11, right side band "13" with waist band "11", and left side band "14" with waist band "11" is such that one can define any desired angular relationship between the respective longitudinal axis thereof upon the selectively affixing of shoulder strap "12" to waist band "11", right side band "13" to waist band "11" and left side band "14 to waist band "11". As a result, and in accordance with the invention, one is able to selectively adjust and otherwise particularize the fit of musical instrument harness "10" to the particular wishes and desires of the musician utilizing same so as to meet said musicians's particular desires of fit to thus minimize fatigue.

In conjunction with the above, left side band "14", although depicted without a VELCRO® arrangement attributable to its end that is adjacent to male snapping means "15", also, however, provides adjustability to its usable length by allowing for VELCRO® patch "28" to be selectively placed along VELCRO® patch "22" at a point where one can achieve the desired length relevant to left side band "14".

Similarly, right side band "13" also has as an additional adjustability feature, similar to that of left side band "14", adjustability being as related to where VELCRO® patch "31" shall come into contact with VELCRO® patch "22".

It is also within the scope of this invention for left side band "14" to be affixed to male snapping means "15" in a fashion similar to that as depicted in FIG. 3 with regard to right side band "13's" attachment to male snapping means "16".

It should also be noted that it is within the scope this invention that the utilization of VELCRO® as hereinabove set forth can be substituted for other fastening means of a similar nature as well as other fastening means well known within the prior art such as snaps, rivets, button and buttonhole combinations, and the like, arranged in sequence to allow for selective adjustment as hereinabove set forth much like how a series of holes appear in a belt to allow for its adjustability as to fit around the waist of a user of the belt.

Figure 1:
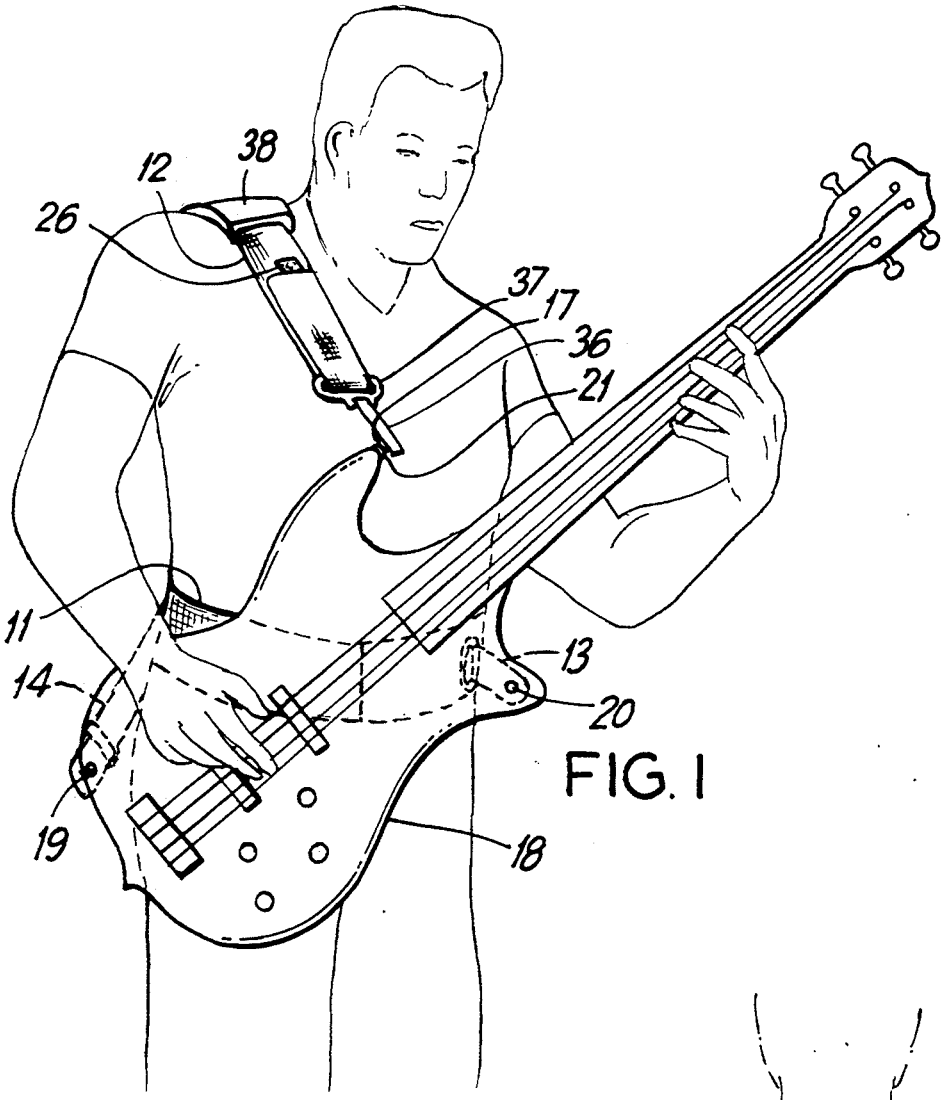
FIG. 1 is a three dimensional front perspective view of a musician evidencing the utilization of the musical instrument harness as constructed in accordance with the invention.
Figure 2:
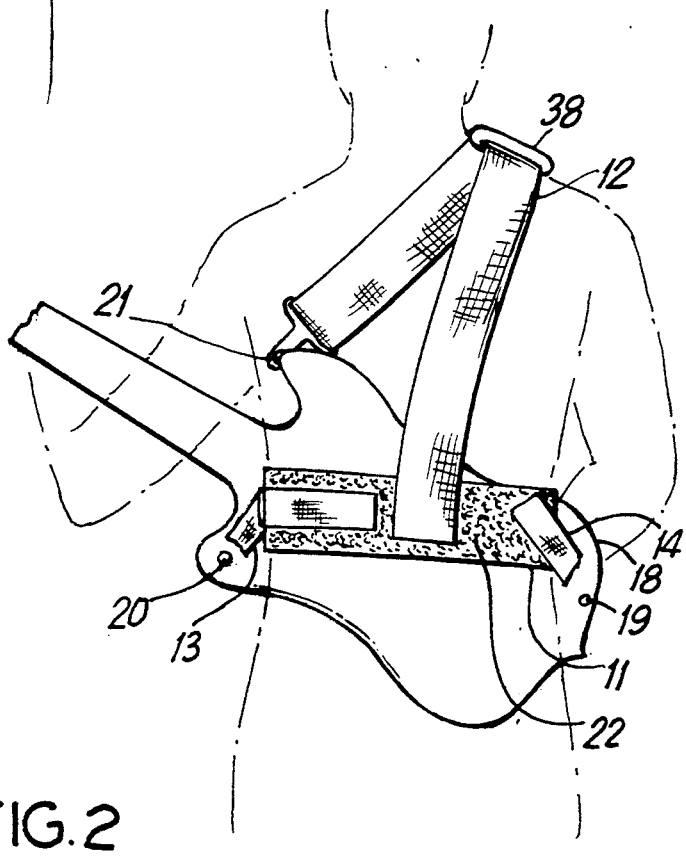
FIG. 2 is a rear view of the musician depicted in FIG. 1 evidencing the utilization of the musical instrument harness constructed in accordance with the invention.

In keeping with the invention, it should be noted that male members "15", "16" and "17" of the snapping means devices depicted in the drawings can be any one of a variety of male member components as related to well known snapping means known within the prior art, the male snapping means depicted in the drawings, and in particular, in FIG. 3, evidencing a male component which can be selectively snapped into and selectively snapped out from the female receptacle component of such a snapping means device, said female snapping components as related to male snapping means "15", "16" and "17" being structurally affixed to the musical instrument to which musical instrument harness "10" is to be attached, reference being made to FIG. 1 herein, wherein there is depicted the locations thereof. More particularly, the female component to male snapping means "15", to wit, female snapping component "19" is affixed to the body of guitar instrument "18" as depicted in FIGS. 1 and 2 of the drawings and located at a point on the body of said instrument as therein depicted. Additionally, the female component of male snapping means "16", to wit, female snapping component "20" is affixed to the body of guitar instrument "18" as depicted in FIGS. 1 and 2. Additionally, the female component to male snapping means "17", to wit, female snapping component "21" is affixed to the body of guitar instrument "18" as depicted in FIGS. 1 and 2. In conjunction with the above, it should be noted that with regard to FIG. 2 of the drawings, right side band "13" and left side band "14" are illustrated in a partial, cut-away manner so as to expose for illustrative purposes the positioning of female snapping means "19" and "20" with regard to guitar instrument "18".

In accordance with the invention, it should be noted that waist band "11", shoulder strap "12", right side band "13" and left side band "14" can be fabricated from any one of a number of materials well known in the prior art, to wit, leather, fabric, webbed belting material and the like, the scope of the invention not being dependent upon the particular composition of material utilized in the fabrication of said component parts.

Additionally, it should also be noted that flap members "32", "34" and "36", as will hereinafter be defined, can also be fabricated from the same material and/or materials utilized to fabricate waist band "11", shoulder strap "12, right side band "13" and left side band "14".

In conjunction with the invention, male snapping means "15" is structurally affixed to flap member "32" which is threaded through loop member "33" which also has the end of left side band "14" fed through loop member "33" as depicted in FIG. 3. As illustrated in FIG. 3, the end of left side band "14", after having been fed through loop member "33" is turned back on itself and affixed thereto either by stitching or some other means of fastening so as to provide a permanent affixing to loop member "33" of left side band "14".

Additionally as depicted in FIG. 3, flap member "32", after passing through loop member "33" is also turned back on itself and affixed thereto either by stitching or some other means of fastening so as to provide a permanent affixing to loop member "33" of flap member "32".

In a similar fashion, male snapping means "16" is structurally affixed to flap member "34" which is threaded through loop member "35" which also has the end of right side band "15" fed through loop member "33" as depicted in FIG. 3. As illustrated in FIG. 3, the end of right side band 13, after having been fed through loop member "35" is turned back on itself in accordance with the invention so as to allow for VELCRO® patch "30" to come into contact with VELCRO® patch "29" so as to provide for the adjustable locking into place of loop member "35" on right side band "13" in accordance with the invention.

Additionally, flap member "34", after passing through loop member "35" is also turned back on itself and affixed thereto either by stitching or some other means of fastening so as to provide a permanent affixing to loop member "35" of flap member "34".

In a similar fashion, male snapping means "17" is structurally affixed to flap member "36" which is threaded through an opening formed in loop member "37" which also has the end of shoulder strap "12" fed through the larger opening formed in loop member "37" as depicted in FIG. 3. As illustrated in FIG. 3, the end of shoulder strap "12", after having been fed through loop member "37" is turned back on itself in accordance with the invention so as to allow for VELCRO® patch "27" to come into contact with VELCRO® patch "26" so as to provide for the adjustable locking into place of loop member "37" on shoulder strap "12" in accordance with the invention. Flap member "36" is also turned back on itself after having been fed through the opening formed in loop member "37" that said flap member passes through and affixes to itself in a manner similar to that as related to flap members "34" and "32".

As so illustrated in the drawings, and in keeping with the invention, cushion member "38", which defines a hollow loop of material, be it fabric, foam rubber, or the like, has shoulder strap "12" fed through its hollow opening as depicted in the drawings and is utilized to further assist in reducing fatigue by helping to soften and otherwise cushion the strain placed upon a musicians shoulders when utilizing musical instrument harness "10".

Upon reference to FIG. "1" of the drawings, there is depicted the utilization of musical instrument harness "10" in accordance with the invention as attached to guitar instrument "18".

As depicted in FIG. "1", male snapping means "17" is affixed to female snapping means "21", which is structurally affixed to guitar "18" Male snapping means "15", as depicted in the drawings, is affixed to female snapping means "19", female snapping means "19" being structurally affixed to guitar "18" as depicted in FIG. 2. Finally, male snapping means "16", as depicted in the drawings, is structurally affixed to female snapping means "20", female snapping means "20" being structurally affixed to guitar "18", as depicted in FIG. 2.

As is evident upon review of FIGS. "1" and "2", guitar instrument "18" is structurally affixed to musical instrument harness "10" at three points, female snapping means "19" and female snapping means "20" providing points of support that address themselves to enabling musical instrument harness "10" to support the bulk of the weight of guitar instrument "18".

It should also be noted that the point of attachment of female snapping means "20" as depicted in the drawings to guitar instrument "18" as therein depicted is at a point of balance to the instrument such that said point of balance represents the pivot point of weight of said instrument whereby said instrument would have its weight equally distributed on both sides of said point, assuming that guitar instrument "18's" balance could be maintained in a vertical plane through which said balance point passes.

It will be understood that the foregoing general description and the following detailed description as well are exemplary and explanatory of the invention, but are not restrictive thereof.

The accompanying drawings referred to herein and constituting a part hereof, are illustrative of the invention but not restrictive thereof, and, together with the description, serve to explain the principles of the invention.

I claim:

1. A musical instrument harness capable of being adjusted to the particular physical characteristics and desires of a musician comprising:

a. a waist band member capable of being selectively affixed about the waist of a musician;

b. a shoulder strap member having one end selectively attachable to said waist band member;

c. a first side band member having one end selectively attachable to said waist band member;

d. a second side band member having one end selectively attachable to said waist band member;

e. a first snapping means capable of being adjustably affixed to the end of said shoulder strap member not selectively attachable to said waist band member;

f. a second snapping means capable of being adjustably affixed to the end of said first side band member not selectively attachable to said waist band member;

g. a third snapping means capable of being adjustably affixed to the end of said second side band member not selectively attachable to said waist band member.

2. A musical instrument harness capable of being adjusted to the particular physical characteristics and desires of a musician, as described in claim 1, comprising VELCRO® patches to selectively attach said waist band member to itself, said shoulder strap member to said waist band member, said first side band member to said waist band member and said second side band member to said waist band member.

* * * * *